US011013948B2

(12) United States Patent
Smith

(10) Patent No.: US 11,013,948 B2
(45) Date of Patent: May 25, 2021

(54) STRENGTH TRAINING APPARATUS

(71) Applicant: Troy Robert Smith, Crown Point, IN (US)

(72) Inventor: Troy Robert Smith, Crown Point, IN (US)

( * ) Notice: Subject to any disclaimer, the term of this patent is extended or adjusted under 35 U.S.C. 154(b) by 3 days.

(21) Appl. No.: 16/381,841

(22) Filed: Apr. 11, 2019

(65) Prior Publication Data

US 2019/0314667 A1 Oct. 17, 2019

Related U.S. Application Data

(60) Provisional application No. 62/656,039, filed on Apr. 11, 2018.

(51) Int. Cl.

| | |
|---|---|
| ***A63B 21/078*** | (2006.01) |
| ***A63B 21/072*** | (2006.01) |
| ***A63B 23/12*** | (2006.01) |
| ***A63B 21/00*** | (2006.01) |

(52) U.S. Cl.

CPC ..... *A63B 21/078* (2013.01); *A63B 21/0724* (2013.01); *A63B 21/4029* (2015.10); *A63B 21/4033* (2015.10); *A63B 23/1281* (2013.01)

(58) Field of Classification Search

CPC . A63B 21/075; A63B 21/029; A63B 21/4033; A63B 21/0626; A63B 21/0036; A63B 21/00; A63B 21/072; A63B 21/0722; A63B 21/0724; A63B 21/0726; A63B 21/0728; A63B 21/078; A63B 21/0783; A63B 21/08; A63B 23/1281;

(Continued)

(56) References Cited

U.S. PATENT DOCUMENTS 3,598,405 A * 8/1971 Burns ..... A63B 21/4029 482/145
4,240,626 A * 12/1980 Lambert, Jr. ..... A63B 21/155 482/100
4,306,715 A 12/1981 Sutherland (Continued)

FOREIGN PATENT DOCUMENTS

CN 101537243 9/2009

OTHER PUBLICATIONS

International Search Report for International Application No. PCT/US2019/033874, dated Jan. 10, 2020, (3 pages).

*Primary Examiner* — Gary D Urbiel Goldner
*Assistant Examiner* — Thao N Do
(74) *Attorney, Agent, or Firm* — Hartman Global IP Law; Gary M. Hartman; Domenica N. S. Hartman

(57) ABSTRACT

A strength training apparatus that includes a base frame configured to rest on a surface, first and second main support arms each extending from the base frame, and a user's platform armrest configured to be releasably secured to distal ends of the first and second main support arms and span therebetween. The apparatus may be used in combination with a weight bench to support a user's arms during supine triceps extensions. The user may lie on the weight bench below the user's platform armrest, hold a free weight with one or both hands, locate and maintain one or both upper arms against a first side of the user's platform armrest, and perform an exercise by repeatedly extending and bending one or both arms at the elbows while their arm(s) are against the user's platform armrest.

13 Claims, 12 Drawing Sheets

(58) Field of Classification Search
CPC . A63B 23/1236; A63B 23/00; A63B 22/0087; A63B 22/00; A63B 21/074
USPC ..... 482/104, 107
See application file for complete search history.

(56) References Cited

U.S. PATENT DOCUMENTS 4,316,609 A * 2/1982 Silberman ..... A63B 21/4031 482/102
4,368,884 A 1/1983 Colvin
4,369,966 A * 1/1983 Silberman ..... A63B 21/154 482/104
4,468,025 A * 8/1984 Sferle ..... A63B 21/068 482/133
4,629,183 A 12/1986 Perrine
4,666,152 A * 5/1987 Jones ..... A63B 21/155 482/137
4,974,839 A 12/1990 Cantor
5,042,799 A * 8/1991 Stanley ..... A63B 21/4035 482/123
5,082,260 A 1/1992 Dinelli
5,141,480 A 8/1992 Lennox et al.
5,281,193 A 1/1994 Colbo, Jr.
5,342,269 A * 8/1994 Huang ..... A63B 21/068 482/130
5,954,620 A * 9/1999 Albritton ..... A63B 21/4029 482/104
6,186,926 B1 * 2/2001 Ellis ..... A63B 21/0615 482/137
6,264,586 B1 * 7/2001 Webber ..... A63B 23/00 482/104
6,450,927 B1 * 9/2002 Ellis ..... A63B 21/078 482/104
6,475,123 B1 * 11/2002 Evans ..... A63B 23/02 428/130
6,645,130 B2 11/2003 Webber
6,689,027 B1 2/2004 Gardikis, Jr.
6,709,370 B1 3/2004 Evans
6,896,644 B1 5/2005 Voigt
7,285,077 B1 * 10/2007 Marx ..... A63B 21/06 482/104
7,585,259 B2 9/2009 Turner
7,658,701 B2 * 2/2010 Webb ..... A63B 21/0628 482/140
7,901,337 B2 3/2011 Webber et al.
8,162,807 B1 * 4/2012 Webber ..... A63B 21/0615 482/100
8,740,760 B2 6/2014 York et al.
8,834,329 B2 9/2014 Kelly
9,044,643 B2 6/2015 Staten et al.
9,050,497 B2 6/2015 Reyes
9,248,337 B1 * 2/2016 Humphrey ..... A63B 21/00181
9,278,244 B2 * 3/2016 Chuang ..... A63B 21/00069
9,480,340 B1 * 11/2016 Harlow ..... A47C 7/006
9,750,971 B1 * 9/2017 Humphrey ..... A63B 21/0083
10,071,276 B2 9/2018 Vorozilchak et al.
10,086,226 B2 10/2018 Nelson et al.
10,143,879 B1 12/2018 Thomas
2004/0259703 A1 * 12/2004 Goh ..... A63B 21/0615 482/140
2005/0124473 A1 * 6/2005 Carlucci ..... A63B 21/4035 482/123
2005/0192166 A1 * 9/2005 Shifferaw ..... A63B 21/078 482/94
2006/0100069 A1 * 5/2006 Dibble ..... A63B 23/03566 482/98
2007/0259762 A1 * 11/2007 Ho ..... A63B 21/159 482/142
2008/0090710 A1 * 4/2008 Chung ..... A63B 23/0494 482/142
2009/0137372 A1 * 5/2009 Gates ..... A63B 26/00 482/142
2010/0016128 A1 * 1/2010 Webber ..... A63B 21/0628 482/94
2010/0323857 A1 * 12/2010 D'Silva ..... A63B 21/0552 482/121
2012/0065038 A1 * 3/2012 Nayebdadash .... A63B 23/0227 482/140
2012/0295771 A1 * 11/2012 LaGree ..... A63B 21/4029 482/94
2014/0187391 A1 * 7/2014 Kelly ..... A63B 21/0783 482/104
2019/0344116 A1 * 11/2019 Bartolotta ..... A63B 21/055

* cited by examiner

STRENGTH TRAINING APPARATUS

CROSS REFERENCE TO RELATED APPLICATIONS

This application claims the benefit of U.S. Provisional Application No. 62/656,039, filed Apr. 11, 2018, the contents of which are incorporated herein by reference.

BACKGROUND OF THE INVENTION

The present invention generally relates to exercise equipment. The invention particularly relates to an apparatus for use in weight training upper arm muscles.

There are many ways to train the upper arm muscles. For example, in order to train triceps gym lifters commonly utilize dumbbells and barbells to perform overhead seated or lying triceps extension exercises. Another form of training the triceps in gyms is the use of a pulley system attached to a weight stack to perform standing triceps cable extensions. As gym equipment have become more popular, numerous elaborate machines have been developed to train the triceps. Some of these machines are plate-selectorized utilizing a weight stack and pin to adjust the amount of resistance, while others are plate-loaded utilizing weight plates to adjust the loads. These machines include various seated versions in which a person extends (straightens) their arms against loads as well as devices that allow a person to perform a dip motion against a load.

All of the above mentioned elaborate machines designed to train the triceps are expensive and are mostly reserved for commercial gym use. Also, even in gyms that have many triceps training machines, people still perform free weight lying triceps extensions (commonly called "skull crushers") with dumbbells or barbells to supplement their arm training. Many forms of lying triceps extension exercises require the user to hold and maintain their arms in a desired/optimal position that isolates the triceps while the user is lying on their back (i.e., supine). However, what is lacking are apparatuses that are commercially available to consumers and configured to assist in establishing and maintaining the proper upper arm position while performing these exercises.

In regards to training the biceps, many elaborate plate-selectorized or plate-loaded machines are available in gyms to train the biceps. Even with these machines available, people still perform free weight biceps curls using barbells and dumbbells just as they still opt to do free weight exercises for their triceps. For biceps, two tools are available and well known to increase the efficacy of biceps free weight exercises: the Preacher Curl bench and the self-wearing "Arm Blaster" platform, which both serve to fixate the upper arm during the curling motion. There is no known comparable device or means to increase the efficacy of free weight lying triceps extension exercises. Trainers may use their hands to hold a person's arms in the proper position during lying triceps extension exercises. However, this method does not necessarily provide proper support to the upper arm, and it may hinder the ability of the trainer to provide good, finessed assistance and spotting throughout the movement. Furthermore, without a trainer present, a person is left without an option for arm support.

In view of the above, it can be appreciated that there are certain problems, shortcomings or disadvantages associated with the prior art, and that it would be desirable if an apparatus were available that was capable of supporting a user's arms in a proper position for performing free weight triceps extensions while a user lies on their back (e.g., skull crushers).

BRIEF DESCRIPTION OF THE INVENTION

The present invention provides an apparatus and methods of using the same suitable for supporting a user's arms in a proper position for performing triceps extensions while the user lies on their back.

According to one aspect of the invention, a strength training apparatus for use with free weights is provided that includes a base frame configured to rest on a surface, first and second main support arms each extending from the base frame, and a user's platform armrest configured to be releasably secured to distal ends of the first and second main support arms and span therebetween. The user's platform armrest has a first side configured to support a user's upper arms while lying on his/her back on a weight bench located below the user's platform armrest.

According to another aspect of the invention, a method of performing a triceps extension exercise using a strength training apparatus and a weight bench is provided that includes locating the weight bench below a user's platform armrest of the strength training apparatus, lying on the weight bench below the user's platform armrest, holding a free weight with one or both hands, locating and maintaining one or both upper arms against a first side of the user's platform armrest, and performing an exercise by repeatedly extending and bending one or both arms at the elbows while holding the free weight and while the one or both arms are against the first side of the user's platform armrest.

Technical effects of the apparatus and method described above preferably include the capability of properly supporting a user's upper arms while the user performs supine triceps extensions during weight training with free weights, thereby promoting muscle building, increased exercise efficacy, increased neurological adaptation, and safety.

Other aspects and advantages of this invention will be further appreciated from the following detailed description.

DETAILED DESCRIPTION OF THE INVENTION

Figure 1:
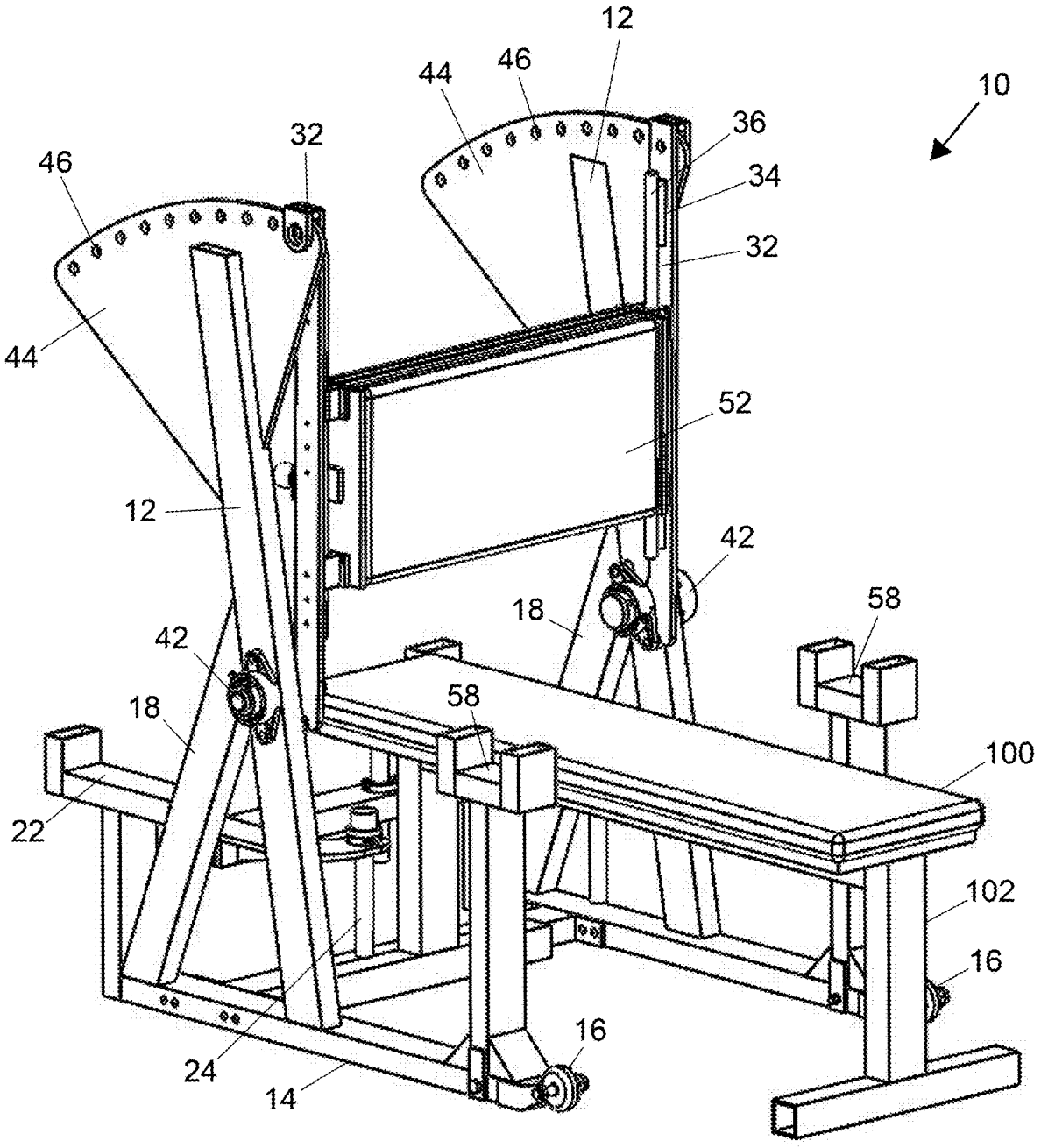
FIGS. 1, 2, and 3 are perspective views representing a strength training apparatus coupled to a weight bench in accordance with a nonlimiting first embodiment of this invention. The apparatus is represented as comprising a user's platform armrest in low vertical, low angled, and high vertical positions, respectively.
Figure 2:
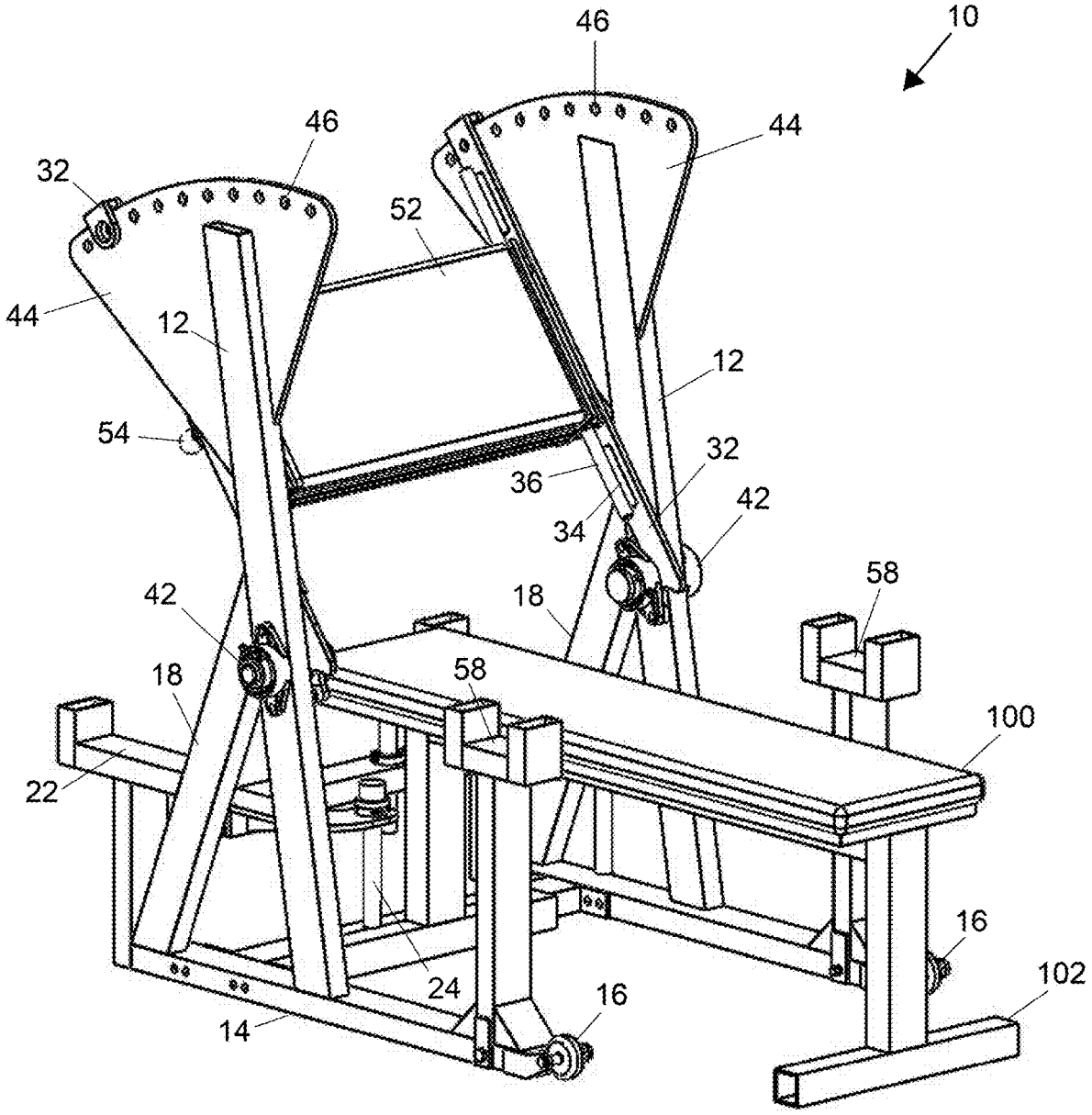
Figure 3:
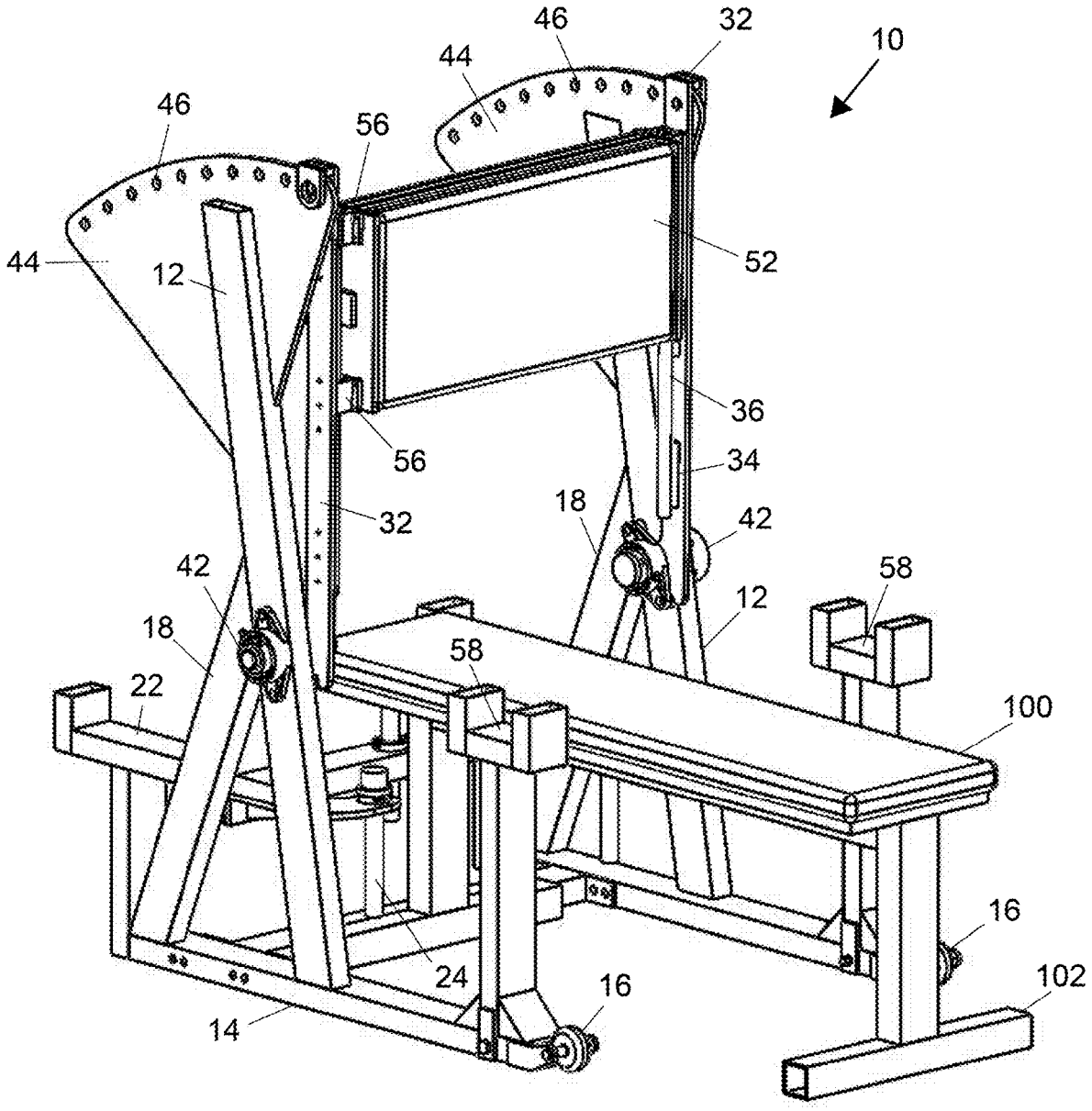

The drawings disclose nonlimiting apparatuses configured to support a user's upper arms during weight training exercises, particularly for training biceps and triceps with free weights. In particular, the apparatuses (referred to hereinafter as training benches) provide for the support and positioning of one's arms during upper arm strength training in order to promote proper technique. The training bench may be used as a stand-alone device or may be used with a weight bench (also commonly referred to as a flat bench or a free weight bench). The training bench may either include or be used in combination with a weight bench in order to support a user's arm while the user is performing supine triceps extensions with barbells, dumbbells, or the like. Preferably, the training bench is configured to position the upper arm(s), for example, approximately zero to forty-five degrees backwards (e.g., toward the head of the weight bench) from vertical. It is also within the scope of the invention that the training bench may be configured to support a user's arms while the user performs curls with barbells, dumbbells, or the like.

To facilitate the description provided below of the training benches represented in the drawings, relative terms, including but not limited to, "vertical," "horizontal," "lateral," "front," "rear," "side," "forward," "rearward," "upper," "lower," "above," "below," "right," "left," etc., may be used in reference to an orientation of the benches during their use. All such relative terms are intended to indicate the construction, installation and use of the benches and therefore help to define the scope of the invention.

In order to assist in both triceps and biceps weight training as described above, the training benches shown in the drawings preferably include a suspended, double-sided platform (as part of what will be referred to herein as a user's platform armrest, or UPA) that may be located above a weight bench to support a user's upper arms while lying on his/her back on the weight bench. The platform may be adjustable in both an upward/downward fashion (e.g., relative to the weight bench) as well as an angular fashion with respect to vertical. The training bench can be either removable from the weight bench it connects with, or it can be permanently connected to the weight bench as an all-in-one device. If the training bench is permanently coupled to a weight bench, it preferably has the ability to collapse while connected to the weight bench such that it does not interfere with other exercises for which the weight bench may be used.

FIGS. 1 through 7 schematically represent various aspects of a training bench 10 in accordance with a first nonlimiting embodiment. The nonlimiting embodiment of the training bench shown in the drawings is configured to be connected with a commercially available weight bench 100 to provide the aforementioned UPA whose suspended platform has two surfaces or sides, a first side against which a user's upper arm(s) can be placed during lying triceps extensions and a second side against which the user's upper arm(s) can be placed during standing or kneeling biceps curls.

The training bench 10 includes first and second main support arms 12 that extend from a base frame 14 at an approximate angle of ten degrees from vertical leaning toward the back of the weight bench 100. The base frame 14 has wheels 16 attached to the front side thereof so that the bench 10 is portable and can be more easily moved. There are at least two support braces 18 that give structural support to the main support arms 12. These support braces 18 attach to each of the main support arms 12 on one end and to the base frame 14 on the other. A cross brace 20 spans across from each of the support braces 18. The height of this cross brace 18 is preferably low enough (relative to ground) to fit below most commercially available weight benches (for example, approximately eleven inches above from the ground).

Front and rear barbell racks are provided comprising rack platforms 58 and 22, respectively, that are configured to accept and support barbells. The rack platforms 22 and 58 may include rubber stoppers or padding thereon to protect the barbells and mitigate noise. The rack platforms 22 and 58 could be, for example, approximately twenty-five inches apart to accept standard EZ Curl barbells. For the front racks, the platforms 58 could be, for example, nineteen inches above the ground in order for the bars to rest on them without touching the weight bench 100. For the rear racks, the platforms 22 could be, for example, approximately thirteen inches from ground in order for the resting position of the barbell to be approximately five inches below the common height of most existing benches (e.g., about eighteen inches). The front racks can be permanently affixed to the base frame 14 as represented or may be removable via pegs or via some other mechanical means.

The bench 10 includes a central abutment rod 24 positioned within a centrally located hole of the cross brace 20, and a pair of lateral abutment rods 24 slidably coupled to the cross brace 20 with lateral abutment guides (LAG, 60). Each abutment rod 24 includes a bumper 28 secured to a top end plate 26 of the rod 24. The abutment rods 24 are located within and surrounded by clamps 30 above or below the cross brace 20 or the lateral abutment guides 60 and are capable of securing the position of the respective abutment rod 24 and bumper 28 once positioned to the appropriate height against the weight bench.

The lateral abutment guides 60 surround the cross brace 20 and can slide laterally to position the corresponding lateral abutment rods 24. Although not shown, these guides 60 may include handles and/or locks to secure each guide 60 along the cross brace 20. If the lateral abutment guides 60 include locks with spring-loaded pull-pins, the cross brace 20 may include holes to accept lock pins. Alternatively, the guides 60 may include screw-type locks to allow for a plurality of positioning possibilities along the cross brace 20.

In order to secure the training bench 10 to the weight bench 100, one or more of the abutment rods 24 may be positioned below the weight bench 100, raised until their bumpers 28 contact surfaces on an underside of the weight bench 100, and then secured in such position with the clamps 30. In this arrangement, the abutment rod(s) 24 prevents the training bench 10 from tilting forward when a user puts forward forces on the platform of the UPA, such as when performing lying triceps extensions. Additionally, the weight of the bench 100 on the abutment rods 24 reduces the likelihood that the bench 100 will unintentionally move relative to the training bench 10 during use. If the lateral abutment guides 60 include locks, the lateral abutment rods 24 may be slid laterally until they contact opposite sides of a frame 102 of the weight bench 100 thereby pinning the weight bench 100 between the lateral rods 24.

Figure 4:
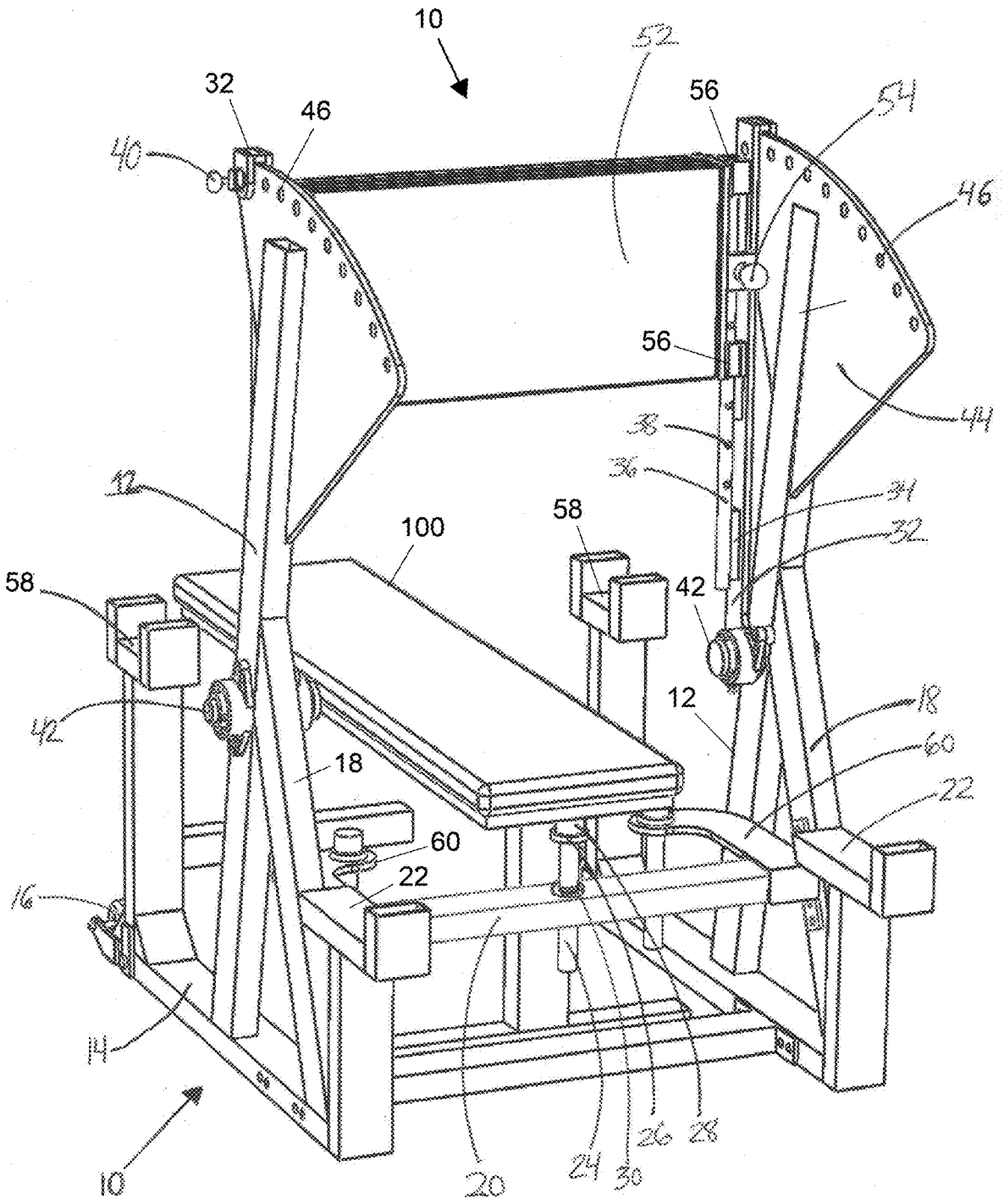
FIG. 4 is a perspective view of the strength training apparatus of FIGS. 1 through 3 from a reverse angle representing the apparatus as coupled to the weight bench and having the user's platform armrest in a high vertical position.
Figure 7:
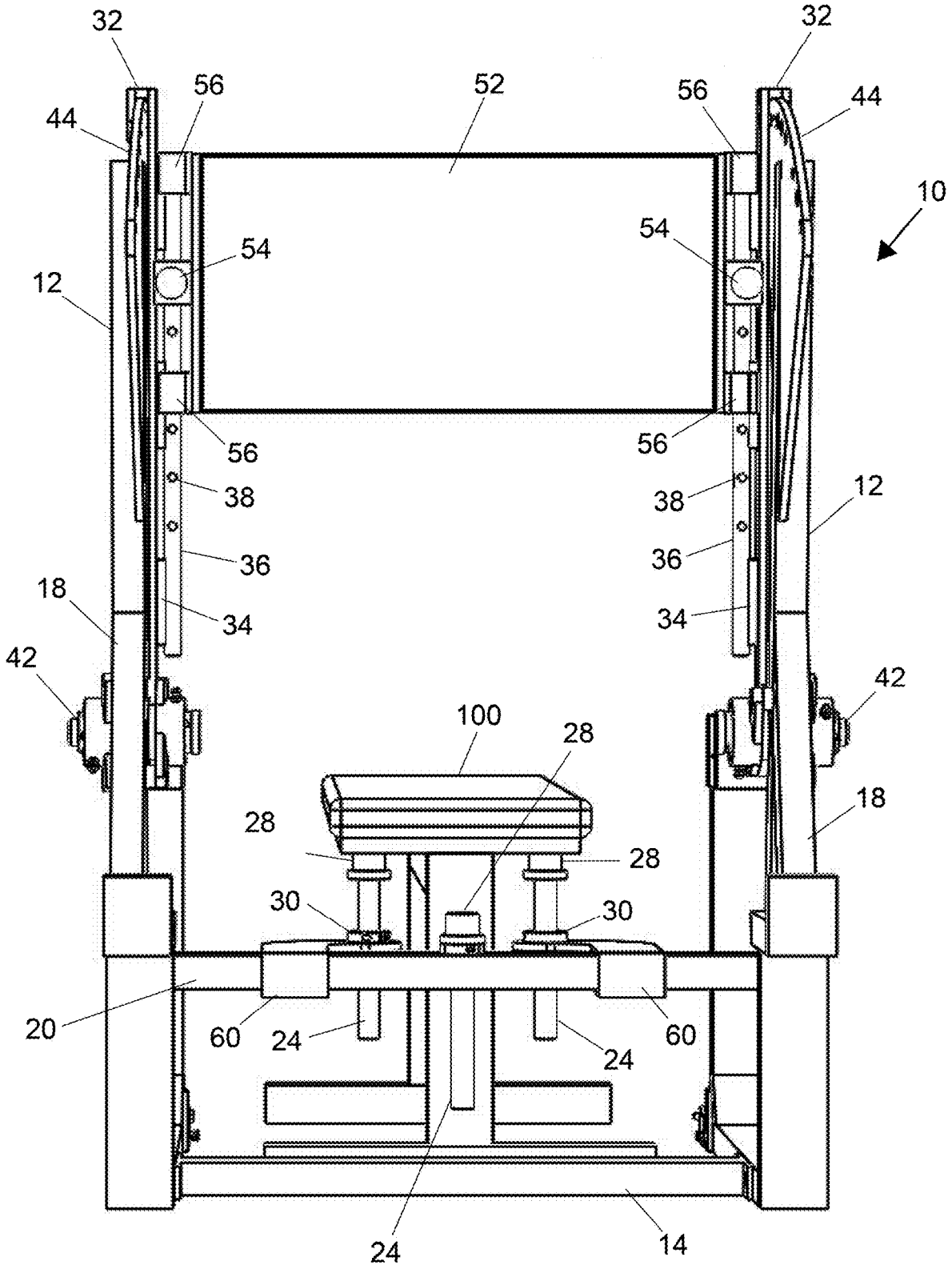
FIG. 7 is an end view of the strength training apparatus of FIGS. 1 through 5 represented as coupled to the weight bench.

The training bench 10 may be coupled to the weight bench 100 with one, two, or all three of the abutment rods 24. For example, FIG. 4 represents the weight bench 100 secured with only the central abutment rod 24, whereas FIG. 7 represents the weight bench 100 as secured with both of the lateral abutment rods 24 but not the central abutment rod 24. Providing all three abutment rods 24 allows the training bench 10 to be secured to a variety of weight benches. For example, when the training bench is used with a weight bench that has support legs at the ends of the weight bench (i.e., little or no overhang), the adjustable lateral abutment guides 60 may still be used to secure the weight bench even though the central abutment rod 24 may not be capable of bracing the weight bench. In addition, it is foreseeable that a weight bench may be secured with only the lateral abutment rods 24 when the weight bench includes the capability of lowering a head rest portion thereof, i.e., a bench with a declinable bench head as known in the art. Such a capability allows a user's head to rest at a position below the plane of the flat upper surface of the weight bench when the user is lying supine, and is believed to provide for a greater range of motion for lying triceps extensions.

On the medial side of each main support arm 12 is a platform guide arm (PGA) 32 that attaches to the main support arm 12 via the platform guide arm hinge joint 42. Atop each main support arm 12 is a PGA locking plate 44 that extends outward away from the main support arms 12 toward both the front and the back of the training bench 10. Each of these PGA locking plates 44 is represented as having approximately ten holes 46 that are equidistant from the PGA hinge joint 42. These holes 46 are spaced to allow the platform guide arms 32 to be positioned at various angles, for example, ranging from approximately zero to forty-five degrees from vertical. Cylindrical PGA rails 36 are secured to the platform guide arms 32 and spaced apart therefrom with spine buildouts 34.

Figure 5:
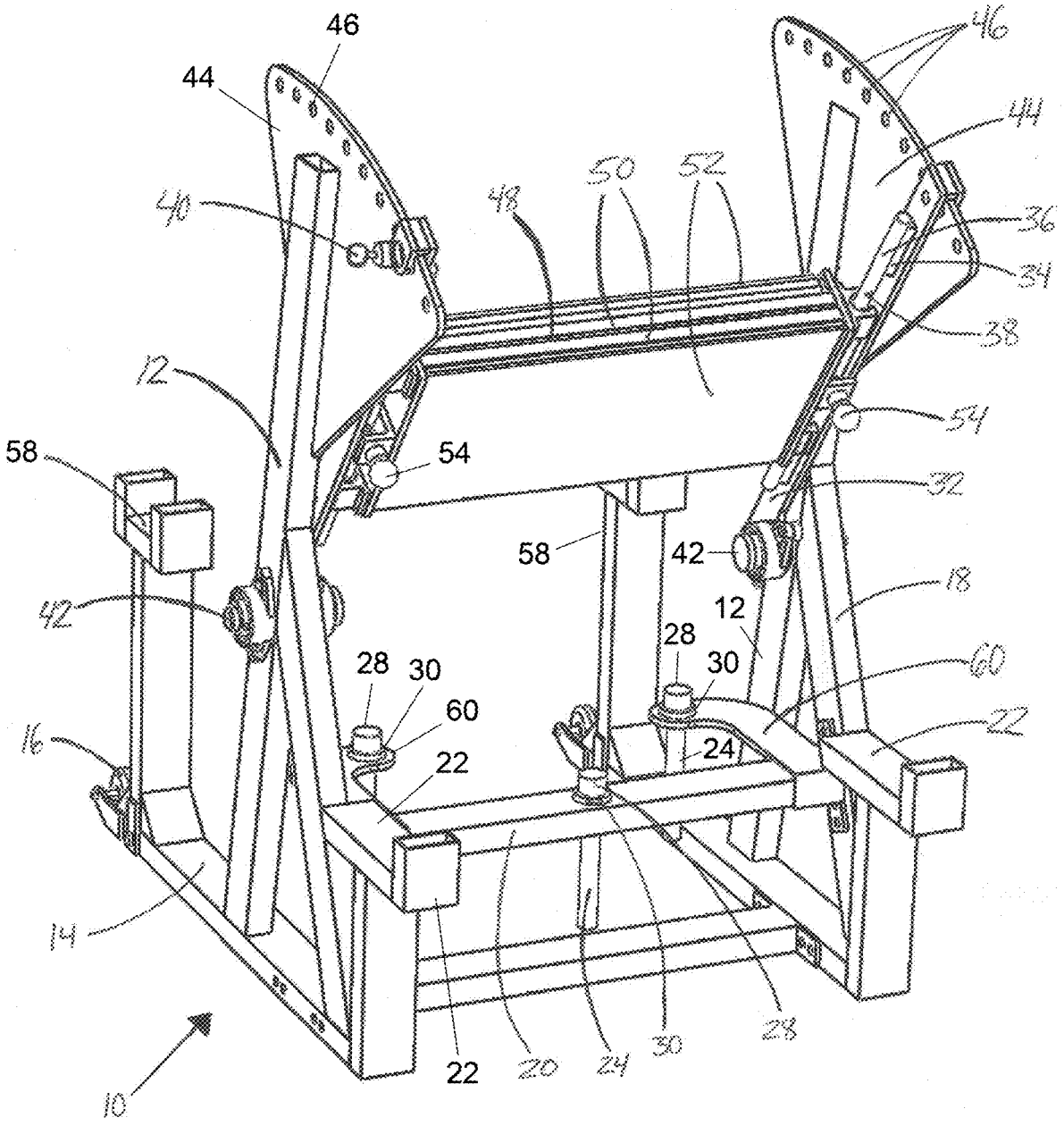
FIG. 5 is a perspective view of the strength training apparatus of FIGS. 1 through 3 from a reverse angle representing the apparatus without the weight bench and having the user's platform armrest in a low angled position.
Figure 6:
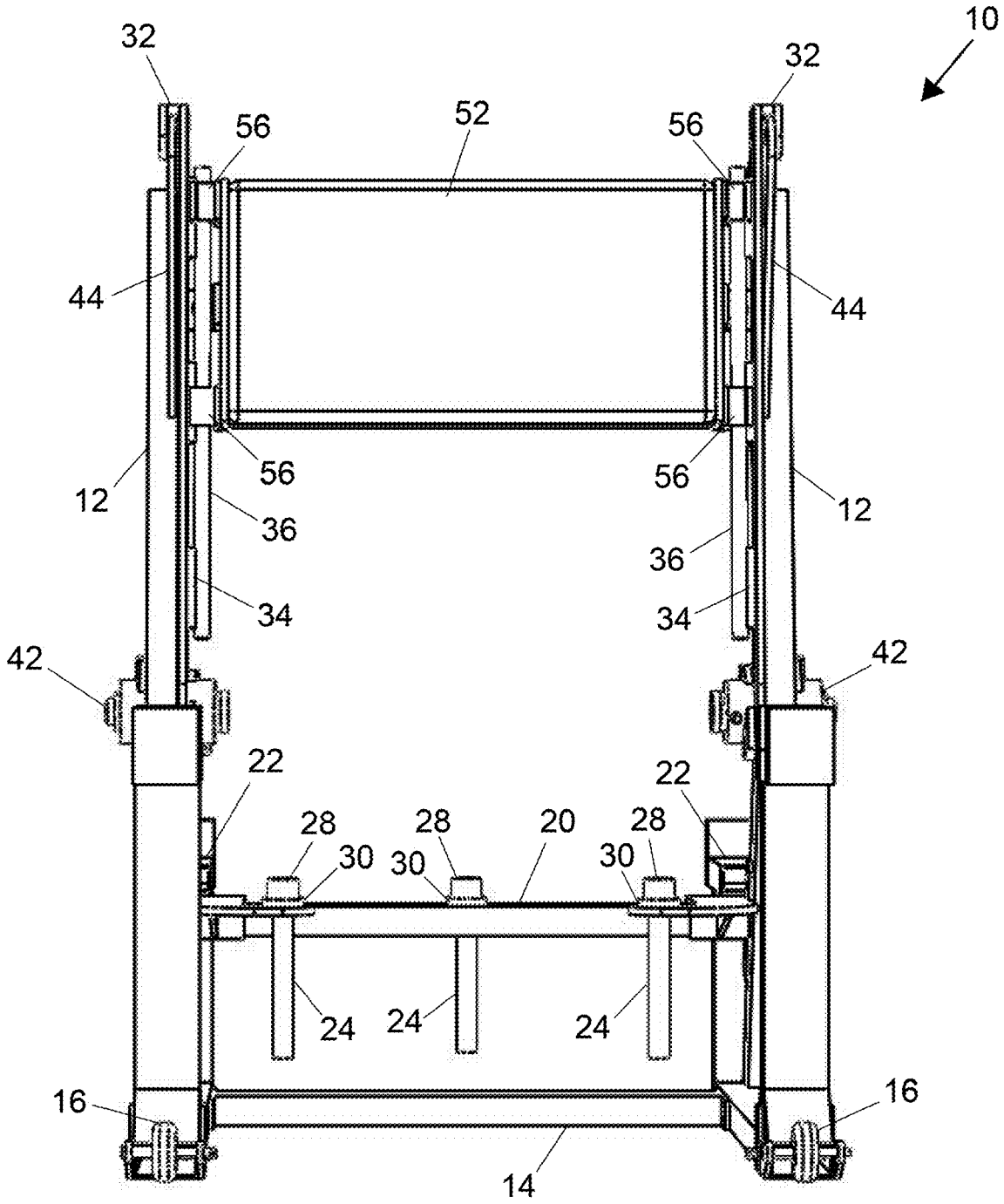
FIG. 6 is an end view of the strength training apparatus of FIGS. 1 through 5 represented without the weight bench.

The aforementioned dual-sided UPA is composed of a UPA frame 48 that has a UPA base surface 50 and at least one UPA pad 52 covering the sides of the UPA frame 48 (FIG. 5). Each UPA pad 52 may include a cushioning material encased by vinyl, leather, or some other material. The ends of the UPA frame 48 are coupled to C- or U-shaped brackets 56 configured to fit around and slide along the PGA rails 36. The UPA frame 48 also has two, spring-loaded UPA pull-pins 54 located on each end. These pull pins 54 include lock pins configured to mate with holes 38 along the PGA rails 36 and allow the UPA to be locked into varying positions along the PGA rails 36. The platform guide arms 32 themselves have spring-loaded guide arm pull-pins 40 with lock pins that allow for the PGA/UPA complex to be secured at the varying angles. Adjusting the angle of the UPA relative to vertical allows for adjusting the relative loads experienced by users at particular ranges of motion during use and adjusting the fixation angle based on user preference. It is believed that adjusting the UPA to angles increasingly further from vertical (e.g., up to about forty-five degrees) may promote improved targeting of the long head of the triceps.

As shown in the figures, the central axes of the platform guide arm 32, the spine buildouts 34, and the PGA rails 36 are offset forward of the PGA hinge joint 42. Such orientation may account for the thickness of the UPA frame 48, base surface 50, and pad 52 and thereby allow the user's anatomical pivot point (i.e., the shoulder joint) to be more closely aligned with the PGA hinge joint 42 as well as account for the distance from the central axis line running from the shoulder through the middle of the humerus bone to a parallel line running tangent to the outside of the back of the arm (outer surface of the triceps muscle). Locating the user's anatomical pivot point to be more closely aligned with the PGA hinge joint 42 allows the user to remain positioned in the same location atop the weight bench 100 irrespective of which angle the UPA is positioned. The offset may be about two inches (about 5 cm) or more, for example, up to about 3.5 inches (about 9 cm), to align the shoulder with the hinge joint 42.

Although not shown, the training bench 10 may include a handle or other device capable of promoting insertion and removal of the user's platform armrest (48-52) from the platform guide arms 32. In addition, the training bench 10 may include an appendage or other means for hanging or storing the UPA when not in use. While the UPA is represented as relatively planar, it may alternatively include various mold shapes to cup the elbows more ergonomically. The UPA may also include lateral supports on each side thereof to serve as side braces for the user's arms to rest against, laterally. These supports may be fixed at the outer edges of the UPA, or, they may be laterally adjustable allowing them to be spaced closer together or further apart. In addition, the UPA pads 52 on opposite sides of the UPA frame 48 could differ in structure from one another since they are intended to be used for different exercises (i.e., triceps extensions vs. biceps curls). For example, the front UPA pad 52 (preacher curling side) could include thicker padding. In addition, padding (not shown) may be included on the top of the UPA, or the UPA pads 52 may include rounded padding buildup at the top of the UPA to provide a rounded UPA top for user comfort, for example, when doing the biceps curling exercises.

The training bench 10 may also have two handles attached to the back of the frame 14, rear racks, or cross brace 20 in order to more easily roll the device around. Horizontal weight plate/clip rods may also be provided to extend from side braces of the rear racks for the purpose of storing weight plates and/or weight clips.

The training bench 10 allows the user to lie on his or her back (supine) underneath a suspended platform (i.e., the UPA). The user may contact a first side of the UPA with posterior portions of the user's arms between the shoulder and elbow and extend and retract their arms at the elbow while holding free weights (e.g., perform triceps extensions or skull-crushing exercises) in order to train their triceps. Unlike other exercise machines, the training bench 10 provides a means of positioning and fixating the upper arm(s) while doing free weight triceps extensions on basic weight benches.

The training bench 10 can adjust to accommodate users of various sizes as well as to change how far back from vertical the upper arm will remain throughout the triceps extension motion and/or the biceps curling motion. This apparatus is believed to promote the efficacy of all free weight skull-crushing exercises performed by individuals in their homes as well as at gyms that may or may not have elaborate triceps weight machines. The self-contained rack platforms 22 are capable of supporting barbells and the like to promote ease of a user to grab and set down a barbell by him/herself from the supine position. Furthermore, the training bench 10 can double as a biceps-training device where the user places one knee on the training bench 10 or the weight bench 100 and executes biceps curls utilizing the reverse side of the user's platform armrest (UPA) to support their arm(s). Although not shown, knee placement pads may be located atop the cross brace 20 or atop each lateral abutment guide 60 for the purpose of placing one knee against the training bench 10 while performing standing biceps curling exercises with it.

The training bench 10 may include various additional features suitable for promoting its intended use. For example, it may include adjustable end range of motion target bumpers to limit and define a range of motion. Mechanical resistance/assistance may be applied at the end ranges of motion to facilitate and encourage constant tension training, that is, dampen or assist the forces experienced at the end ranges of motion to facilitate fluid transitional changes of direction, thereby sustaining muscular tension and neural output throughout the transitional changes from the eccentric to concentric as well as concentric to eccentric phases of motion.

FIGS. 8 through 16 schematically represent a training bench 110 in accordance with a second nonlimiting embodiment. In these drawings, consistent reference numbers are used to identify the same or functionally equivalent elements, but with a numerical prefix (1) added to distinguish the second embodiment from the first embodiment of FIGS. 1 through 7. In this embodiment, main support arms 112 are collapsible to lower downward when not in use, thereby eliminating the need to roll the device away should someone desire to use the weight bench 100 for another exercise. In view of similarities between the first and second embodiments, the following discussion of FIGS. 8 through 16 will focus primarily on aspects of the second embodiment that differ from the first embodiment in some notable or significant manner. Other aspects of the second embodiment not discussed in any detail can be, in terms of structure, function, materials, etc., essentially as was described for the first embodiment.

Figure 8:
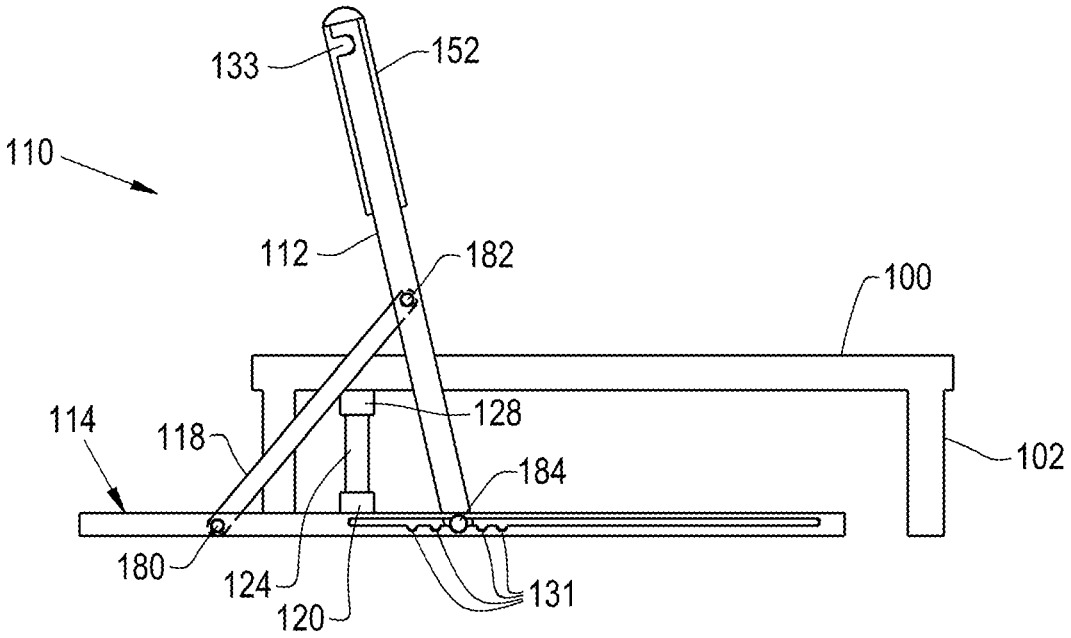
FIG. 8 is a side view representing a collapsible strength training apparatus coupled to a weight bench in accordance with a nonlimiting second embodiment of this invention. The apparatus is represented in a raised or expanded configuration.
Figure 9:
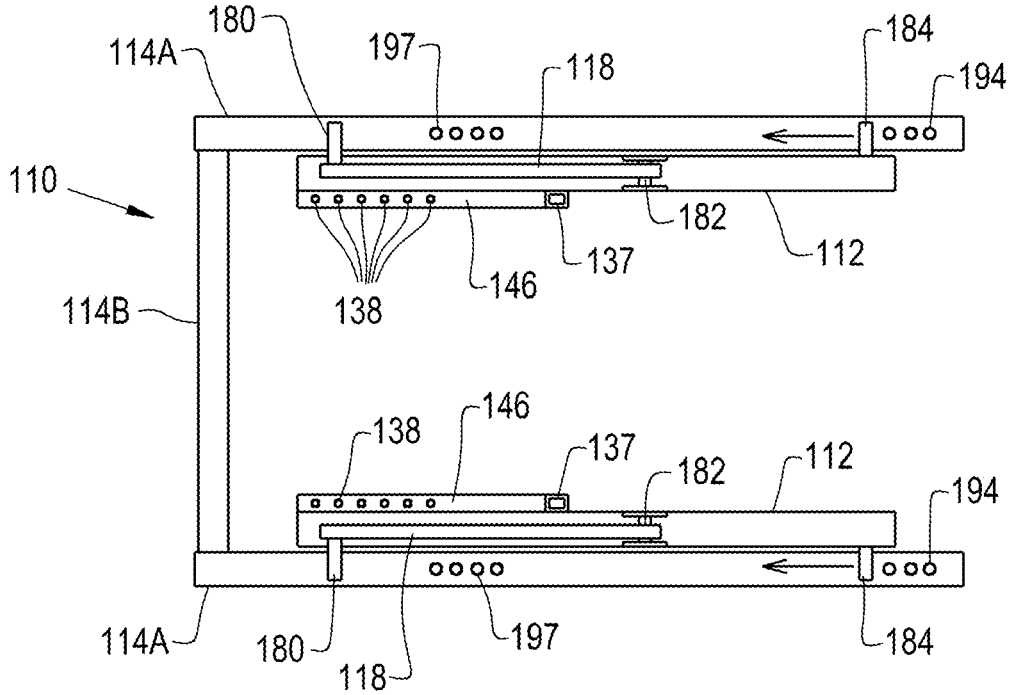
FIG. 9 is a top view of the strength training apparatus of FIG. 8 represented in a collapsed configuration.
Figure 10:
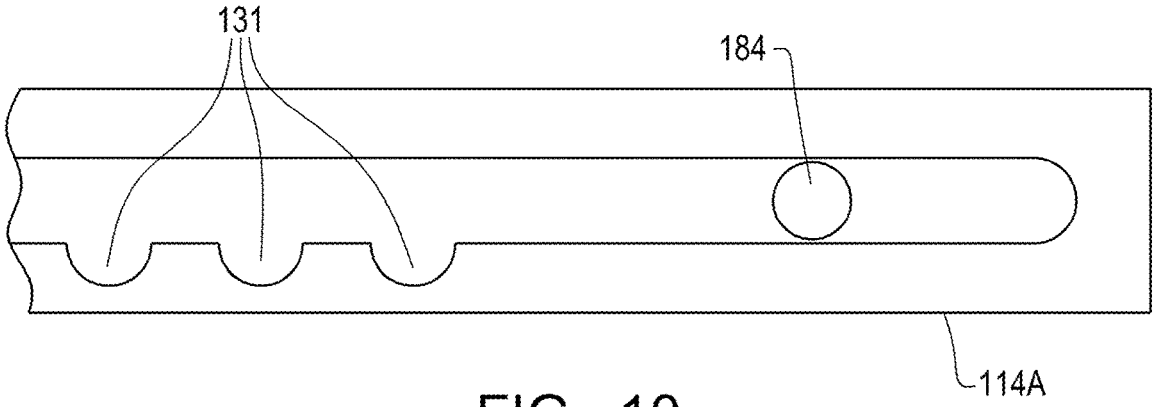
FIGS. 10 and 11 are isolated views representing components of the strength training apparatus of FIGS. 8 and 9 suitable for allowing the apparatus to expand and collapse.

FIG. 8 represents the training bench 110 as secured to the weight bench 100. The support arms 112 are raised in an expanded upward position over the weight bench 100. The main support arms 112 are coupled to a base frame 114 and supported in the expanded position by support braces 118. In order to allow the device to be collapsible, the support braces 118 are coupled to both the main support arms 112 and the base frame 114 with pivoting joints 182 and 180, respectively. Lower ends of the main support arms 112 are coupled to side members 114A of the base frame 114 with connector pegs 184. The side members 114A are fixed to one another with an end member 114B. The side members 114A include longitudinal slots that allow the connector pegs 184 to slide along the lengths of the side members 114A as the main support arms 112 are raised to an expanded configuration. Notches 131 provided along the longitudinal slots are configured to releasably receive the connector pegs 184 to support the ends of the main support arms 112 at multiple positions along the slots, thereby allowing the main support arms 112 to be positioned at various angles relative to the weight bench 100. The main support arms 112 include notches 133 to accommodate the joints 180 when collapsed.

Figure 11:
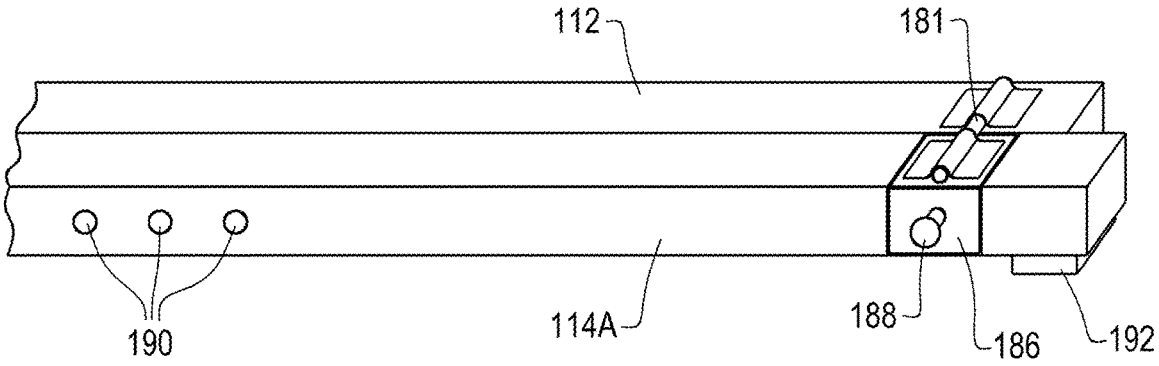

FIG. 11 represents an alternative embodiment in which the slots and notches 131 are replaced with frame guides 186 configured to slide along the side members 114A. The frame guides 186 are coupled to the main support arms 112 with pivoting joints 181. The frame guides 186 include pull-pins 188 with lock pins that can be located in holes 190 along the length of the side members 114A to secure ends of the main support arms 112 along the side members 114A. In this embodiment, feet 192 are used to elevate the base frame 114 to provide clearance for the frame guides 186 to slide.

Figure 12:
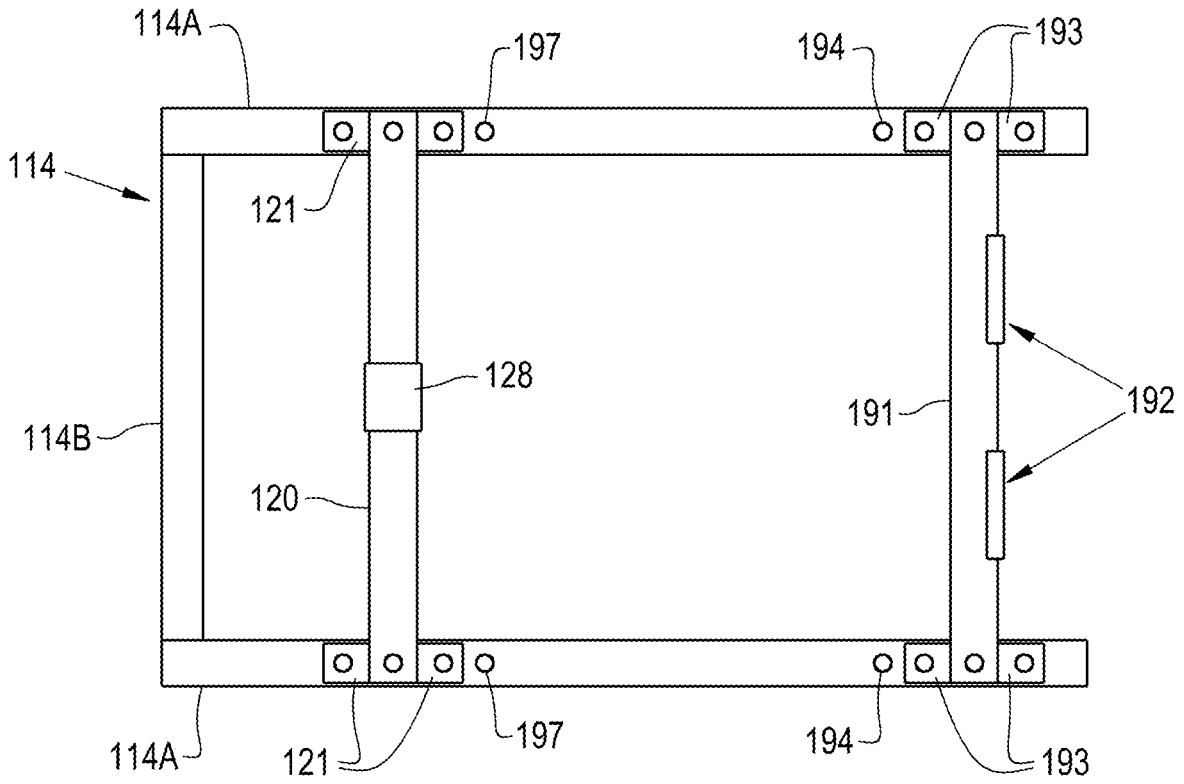
FIG. 12 is a top view of the strength training apparatus of FIGS. 8 and 9 representing an abutment assembly and a heel hook assembly secured to the apparatus. Portions of the apparatus are omitted for clarity.
Figure 13:
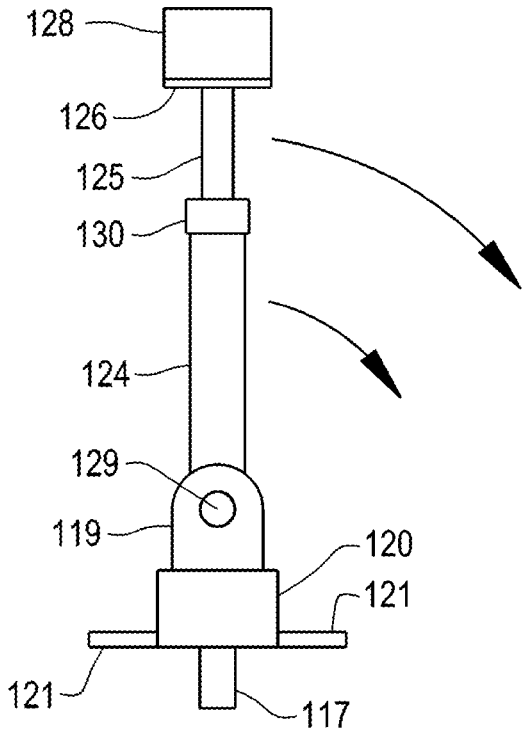
FIG. 13 is a side view of the abutment assembly of FIG. 12.
Figure 14:
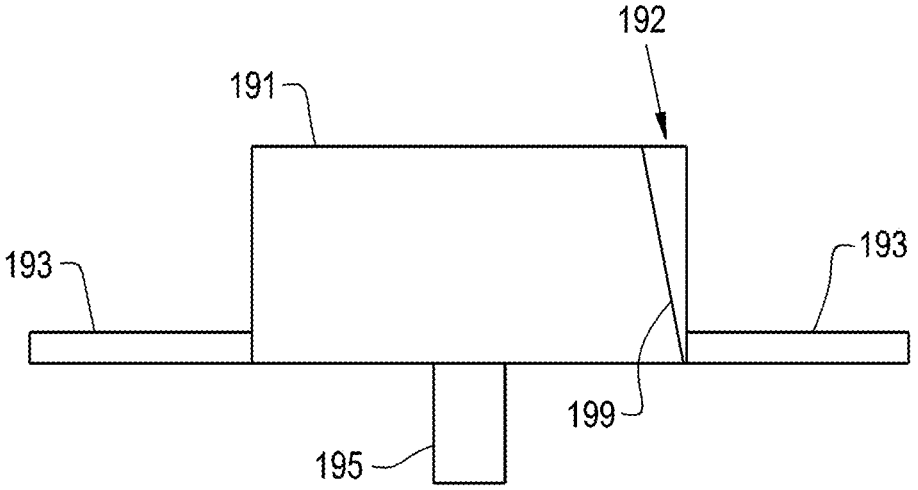
FIG. 14 is a side view of a heel hook assembly of FIG. 12.

FIGS. 12 and 13 represent an abutment assembly and a heel hook assembly coupled to the base frame 114. In FIG. 12, the main support arms 112 have been omitted for clarity. The abutment assembly includes a cross member 120 that may be releasably secured to the base frame 114 by inserting one or more pegs 117 on ends of the cross member 120 into holes 197 in an upper surface of the side members 114A. Flanges 121 on sides of the cross member 120 provide additional rotational support. A primary abutment rod 124 is pivotally coupled to the cross member 120 with a pivoting joint 129 in a flange 119. The primary abutment rod 124 is configured to receive in a cavity therein a secondary abutment rod 125 having a more narrow diameter than the primary abutment rod 124, thereby allowing the secondary abutment rod 125 to telescope into and out of the primary abutment rod 124. The position of the secondary abutment rod 125 relative to the primary abutment rod 124 may be secured with a clamp 130. A bumper 128 is coupled to an end plate 126 on an upper end of the secondary abutment rod 125. During use, the abutment assembly may be used to secure the base frame 114 to the weight bench 100 by rotating the primary abutment rod 124 upwards, extending the secondary abutment rod 125 until the bumper 128 contacts an underside of the weight bench 100, and securing the secondary abutment rod 125 with the clamp 130.

The heel hook assembly includes a cross member 191 comprising flanges 193 and one or more pegs 195 on ends thereof that may be used to couple the assembly with the base frame 114 in substantially the same manner as described above in reference to the abutment assembly, that is, by inserting the pegs 195 into holes 194 in the side members 114A. The cross member 191 includes cutouts 192 having an angled surface 199 to which users may place the heels of their feet when performing supine triceps extensions, thereby allowing the users to further brace their bodies. Preferably, the angled surfaces 199 of the cutouts 192 have a rough texture or are covered, for example, with a material configured to improve a user's grip thereof.

Figure 15:
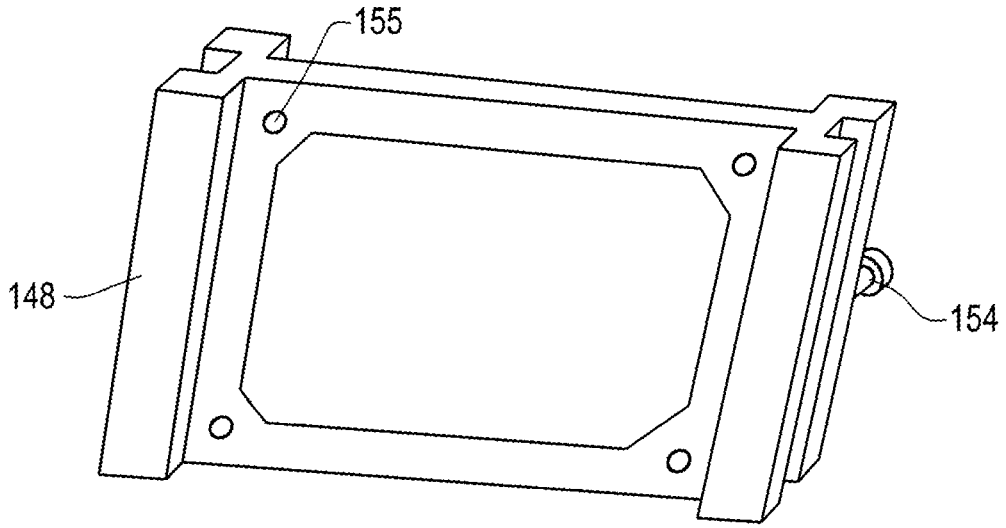
FIG. 15 is an isolated perspective view representing a user's platform armrest frame configured to be received between main support arms of the strength training apparatus of FIGS. 8 and 9.
Figure 16:
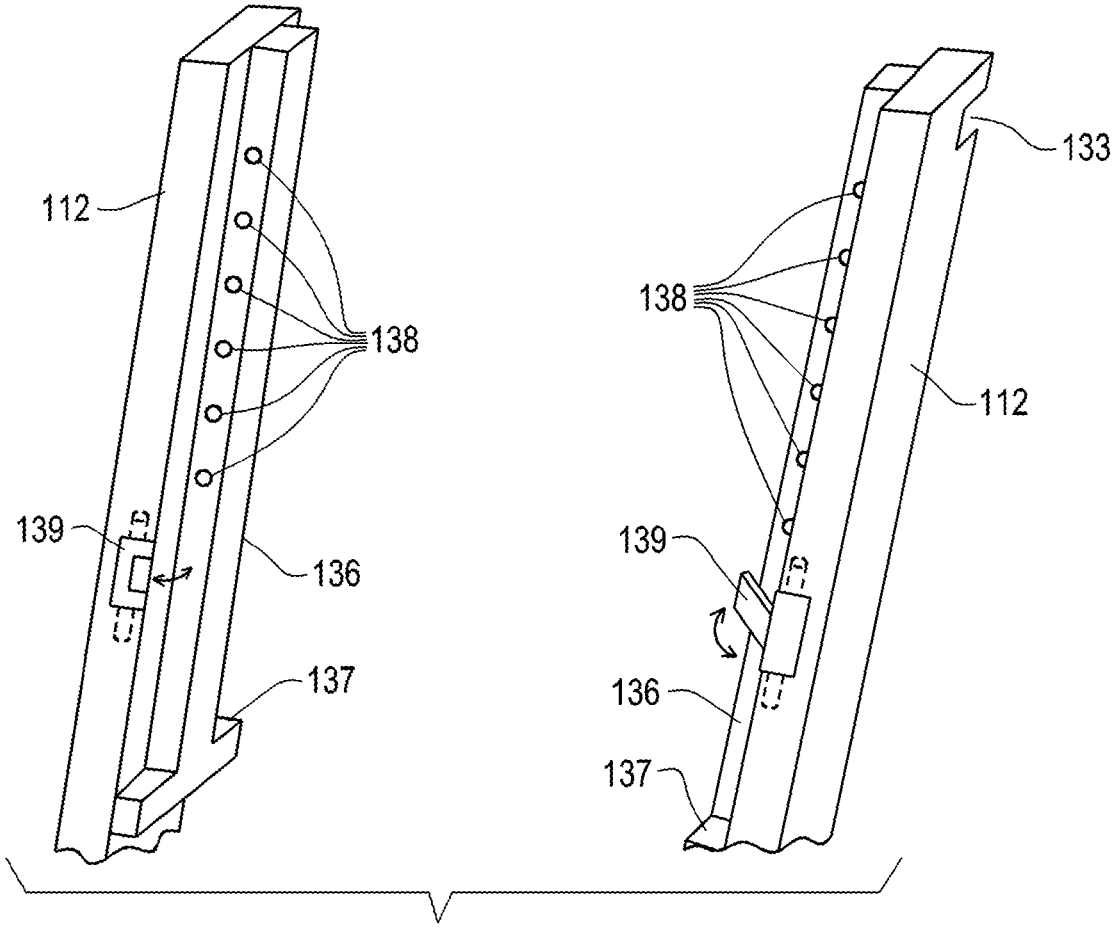
FIG. 16 is an isolated perspective view of the main support arms of the strength training apparatus of FIGS. 8 and 9.

FIG. 15 represents a user's platform armrest (UPA) frame 148 (with the pads 152 and base surfaces 150 omitted for clarity) configured to slidably couple with rectangular guide rails 136 of the training bench 110, the latter of which are shown in isolation in FIG. 16. The UPA frame 148 includes U-shaped ends configured to receive the guide rails 136 and a pull-pin 154 with lock pins that may be inserted into any one of holes 138 along the lengths of the guide rails 136 to vertically position the UPA along the main support arms 112. The UPA frame 148 includes mounting holes 155 for coupling with corresponding base surfaces. The guide rails 136 include stops 137 at ends thereof for limiting the sliding range of the UPA frame 148. In addition or as an alternative to the stops 137, the main support arms 112 may include height-determining locking tabs 139 (FIG. 16) that slide along rails on the main support arms 112, and rotate and snap into closed or open positions along a length of the main support arms 112 allowing a user to choose the bottom end range of where the UPA frame 148 rests during use. This option allows for easy and quick removal of the UPA upon completion of a set, foregoing the need to release the pull-pins 154.

While the invention has been described in terms of specific or particular embodiments, it is apparent that other forms could be adopted by one skilled in the art. For example, the training benches 10 and 110 and their components could differ in appearance and construction from the embodiments described herein and shown in the drawings, functions of certain components of the training benches 10 and 110 could be performed by components of different construction but capable of a similar (though not necessarily equivalent) function, and various materials could be used in the manufacturing of the training benches 10 and 110 and their components. In addition, the invention encompasses additional embodiments in which one or more features or aspects of different disclosed embodiments may be combined. As a nonlimiting example, the embodiment of FIGS. 1 through 7 could incorporate a heel hook assembly of the type represented for the embodiment of FIGS. 8 through 16. Accordingly, it should be understood that the invention is not necessarily limited to any embodiment described herein or illustrated in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A strength training apparatus for use with free weights in combination with a weight bench configured to enable a user to lie supine, the strength training apparatus comprising:

a base frame;

first and second main support arms each extending from the base frame, the first and second main support arms being spaced apart from each other to create a space therebetween for receiving the weight bench;

a brace spanning the space between the first and second main support arms and structurally supporting the first and second main support arms;

means for coupling the strength training apparatus to the weight bench when the weight bench is within the space between the first and second main support arms;

first and second platform guide arms mounted for pivoting relative to the first and second main support arms; and a platform armrest between and interconnecting the first and second platform guide arms so as to be disposed directly above the space between the first and second main support arms and the weight bench received in the space so that a user lying supine on the weight bench is directly below the platform armrest, the platform armrest having a first surface configured to support upper arms of the user while the user is lying supine on the weight bench when the user is directly below the platform armrest.

2. The strength training apparatus of claim 1, wherein the strength training apparatus is connected to the weight bench, the weight bench is within the space between the first and second main support arms, the base frame is permanently coupled with the means for coupling the strength training apparatus to the weight bench, and the platform armrest is directly above the weight bench.

3. The strength training apparatus of claim 1, wherein the strength training apparatus is connected to the weight bench, the weight bench is within the space between the first and second main support arms, the base frame is releasably coupled with the means for coupling the strength training apparatus to the weight bench, and the platform armrest is directly above the weight bench.

4. The strength training apparatus of claim 1, further comprising means for releasably securing the first and second platform guide arms at various angles relative to the first and second main support arms.

5. The strength training apparatus of claim 1, further comprising means for adjusting a height of the platform armrest relative to the first and second main support arms and directly above the space between the first and second main support arms.

6. The strength training apparatus of claim 1, further comprising at least a first rack configured to support a barbell on at least one side of the platform armrest.

7. The strength training apparatus of claim 1, wherein the platform armrest includes a second surface configured to support the user's upper arms while the user's upper arms are located above the platform armrest.

8. A method of performing a triceps extension exercise using the strength training apparatus and the weight bench of claim 1, the method comprising:

locating the weight bench below the platform armrest of the strength training apparatus;

lying supine on the weight bench below the platform armrest;

holding a free weight with one or both hands;

locating and maintaining one or both of the upper arms of the user against the first surface of the platform armrest; and performing an exercise by repeatedly extending and bending one or both arms of the user at corresponding elbows while holding the free weight and while the one or both arms are against a side of the platform armrest.

9. The method of claim 8, further comprising coupling the platform armrest to distal ends of the first and second main support arms extending from the base frame of the strength training apparatus prior to lying supine on the weight bench.

10. The method of claim 8, further comprising adjusting a height and an angle of the platform armrest and declining a head of the weight bench prior to lying supine on the weight bench and under the platform armrest.

11. The method of claim 8, wherein the free weight is a barbell stored on a rack of the strength training apparatus and the method further comprises lifting the barbell from the rack while lying supine on the weight bench prior to performing the exercise and resting the barbell on the rack after performing the exercise.

12. The method of claim 8, further comprising securing the strength training apparatus to the weight bench by extending an abutment rod of the strength training apparatus upwards until a distal end of the abutment rod contacts an underside of the weight bench and securing the abutment rod such that the abutment rod maintains contact with the weight bench.

13. The method of claim 8, further comprising locating and maintaining heels of both feet against a surface of the strength training apparatus while performing the exercise.

* * * * *